US009587391B1

(12) United States Patent
Anderson

(10) Patent No.: US 9,587,391 B1
(45) Date of Patent: Mar. 7, 2017

(54) WALL-MOUNTED CABINET HAVING A BIDET EXTENDABLE THERE FROM

(71) Applicant: Nimrod Anderson, Fresno, CA (US)

(72) Inventor: Nimrod Anderson, Fresno, CA (US)

( * ) Notice: Subject to any disclaimer, the term of this patent is extended or adjusted under 35 U.S.C. 154(b) by 28 days.

(21) Appl. No.: 14/734,068

(22) Filed: Jun. 9, 2015

(51) Int. Cl.
*E03D 9/08* (2006.01)

(52) U.S. Cl.
CPC ..... *E03D 9/085* (2013.01)

(58) Field of Classification Search
CPC ..... E03D 9/085
See application file for complete search history.

(56) References Cited

U.S. PATENT DOCUMENTS 4,000,742 A * 1/1977 Digicomo ..... E03D 9/085 4/420.1
4,596,058 A 6/1986 Nourbakhsh
5,023,961 A 6/1991 Alonso
5,685,028 A 11/1997 Miller
5,893,177 A * 4/1999 Roemen ..... E03D 9/085 4/443
5,991,937 A 11/1999 Safara
6,076,199 A * 6/2000 Na ..... E03D 9/085 4/420.4
6,375,097 B1 * 4/2002 Matteucci ..... E03D 9/085 239/195
6,618,865 B1 9/2003 Kim
D641,069 S 7/2011 Sabato
8,281,423 B2 10/2012 Taylor
2007/0061956 A1 3/2007 Yu

FOREIGN PATENT DOCUMENTS

WO WO0186081 A1 11/2001

* cited by examiner

*Primary Examiner* — Janie Loeppke

(57) ABSTRACT

The wall-mounted cabinet having a bidet extendable there from is an assembly comprised of a valve adapted to be connected to a water line. The valve is controlled via a control knob. A water hose and nozzle connect to and extend from the valve. The water hose and the nozzle extend from a water cabinet, which is accessible via an access door. The water cabinet is positioned above the valve. A mounting frame extends below the access door, and supports the control knob adjacent to the valve. The assembly is installed into a wall surface or a side of an existing cabinet. The assembly may be positioned adjacent to a toilet or a bathroom sink. The assembly enables the water hose and nozzle to function as a bidet, and in concert with the toilet. The access door encloses the nozzle and water hose when not in use.

4 Claims, 6 Drawing Sheets

WALL-MOUNTED CABINET HAVING A BIDET EXTENDABLE THERE FROM

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

The present invention relates to the field of bathroom accessories, more specifically, a bidet that is integrated into a cabinet that is mounted into a wall adjacent to a toilet or a bathroom sink.

SUMMARY OF INVENTION

The wall-mounted cabinet having a bidet extendable there from is an assembly comprised of a valve adapted to be connected to a water line. The valve is controlled via a control knob. A water hose and nozzle connect to and extend from the valve. The water hose and the nozzle extend from a water cabinet, which is accessible via an access door. The water cabinet is positioned above the valve. A mounting frame extends below the access door, and supports the control knob adjacent to the valve. The assembly is installed into a wall surface or a side of an existing cabinet. The assembly may be positioned adjacent to a toilet or a bathroom sink. The assembly enables the water hose and nozzle to function as a bidet, and in concert with the toilet. The access door encloses the nozzle and water hose when not in use.

An object of the invention is to provide a bidet that is operable in concert with a toilet, and which is stored in an assembly that is adapted to be mounted into a wall surface or a side of an existing cabinet.

A further object of the invention is to provide a valve, which is adapted to be connected to a water line that may be located behind the wall surface or underneath the cabinet so as to provide water for use in concert with the water hose and nozzle.

These together with additional objects, features and advantages of the wall-mounted cabinet having a bidet extendable there from will be readily apparent to those of ordinary skill in the art upon reading the following detailed description of the presently preferred, but nonetheless illustrative, embodiments when taken in conjunction with the accompanying drawings.

In this respect, before explaining the current embodiments of the wall-mounted cabinet having a bidet extendable there from in detail, it is to be understood that the wall-mounted cabinet having a bidet extendable there from is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the wall-mounted cabinet having a bidet extendable there from.

It is therefore important that the claims be regarded as including such equivalent construction insofar as they do not depart from the spirit and scope of the wall-mounted cabinet having a bidet extendable there from. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
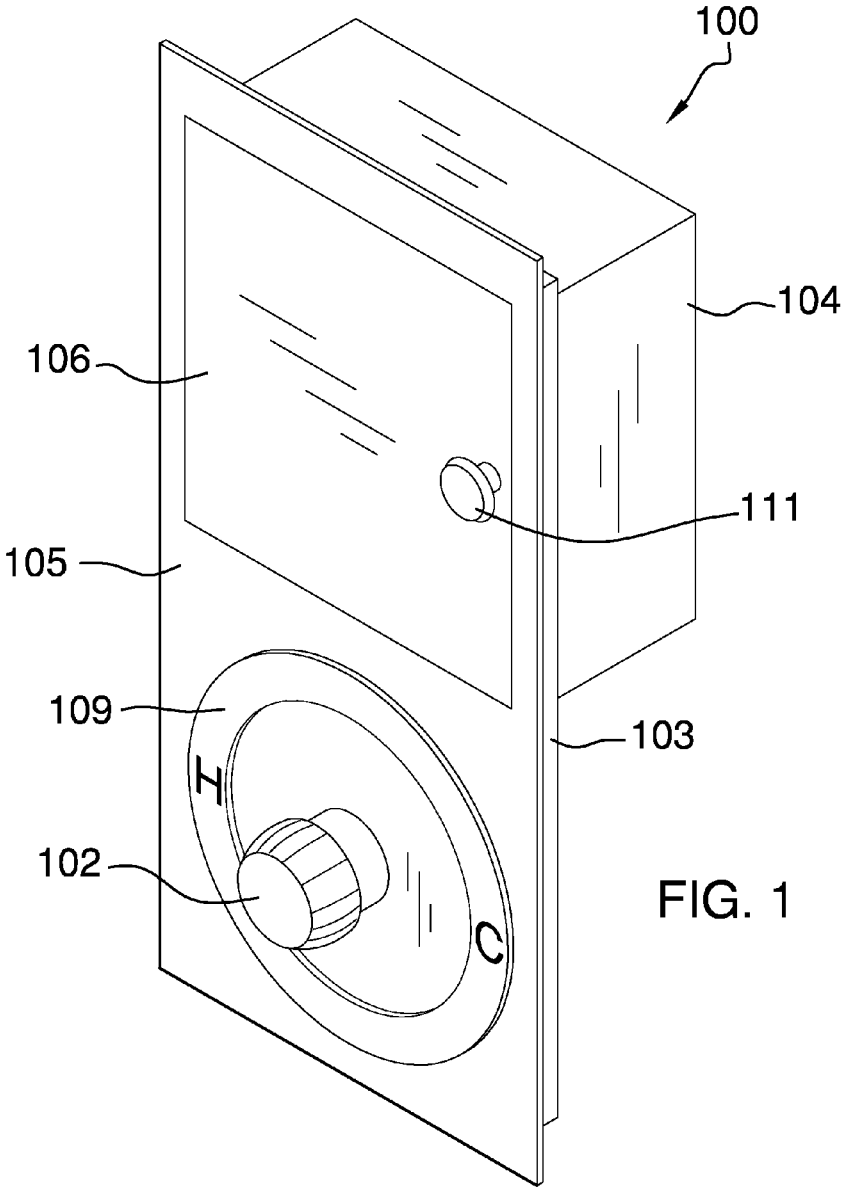
FIG. 1 is a perspective view of an embodiment of the disclosure.
Figure 2:
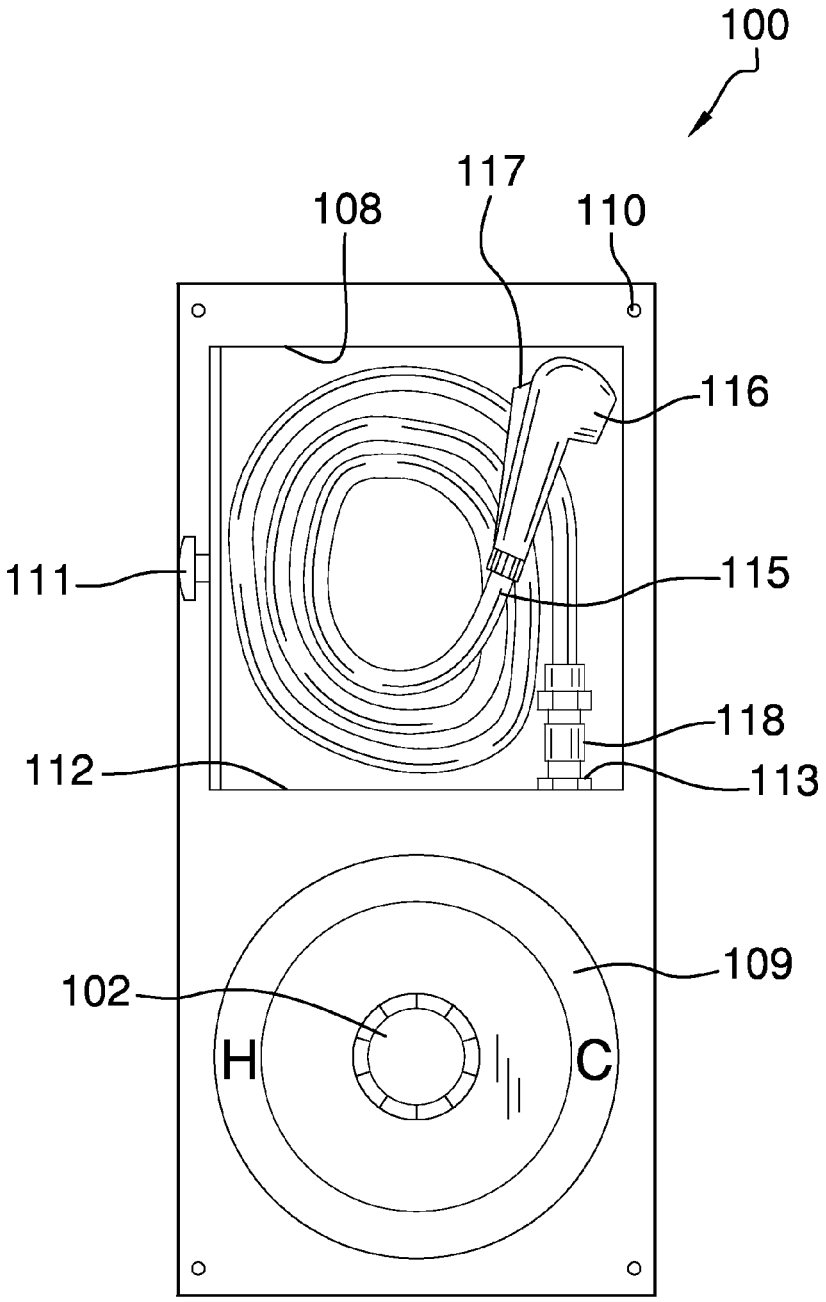
FIG. 2 is a front view of an embodiment of the disclosure.
Figure 3:
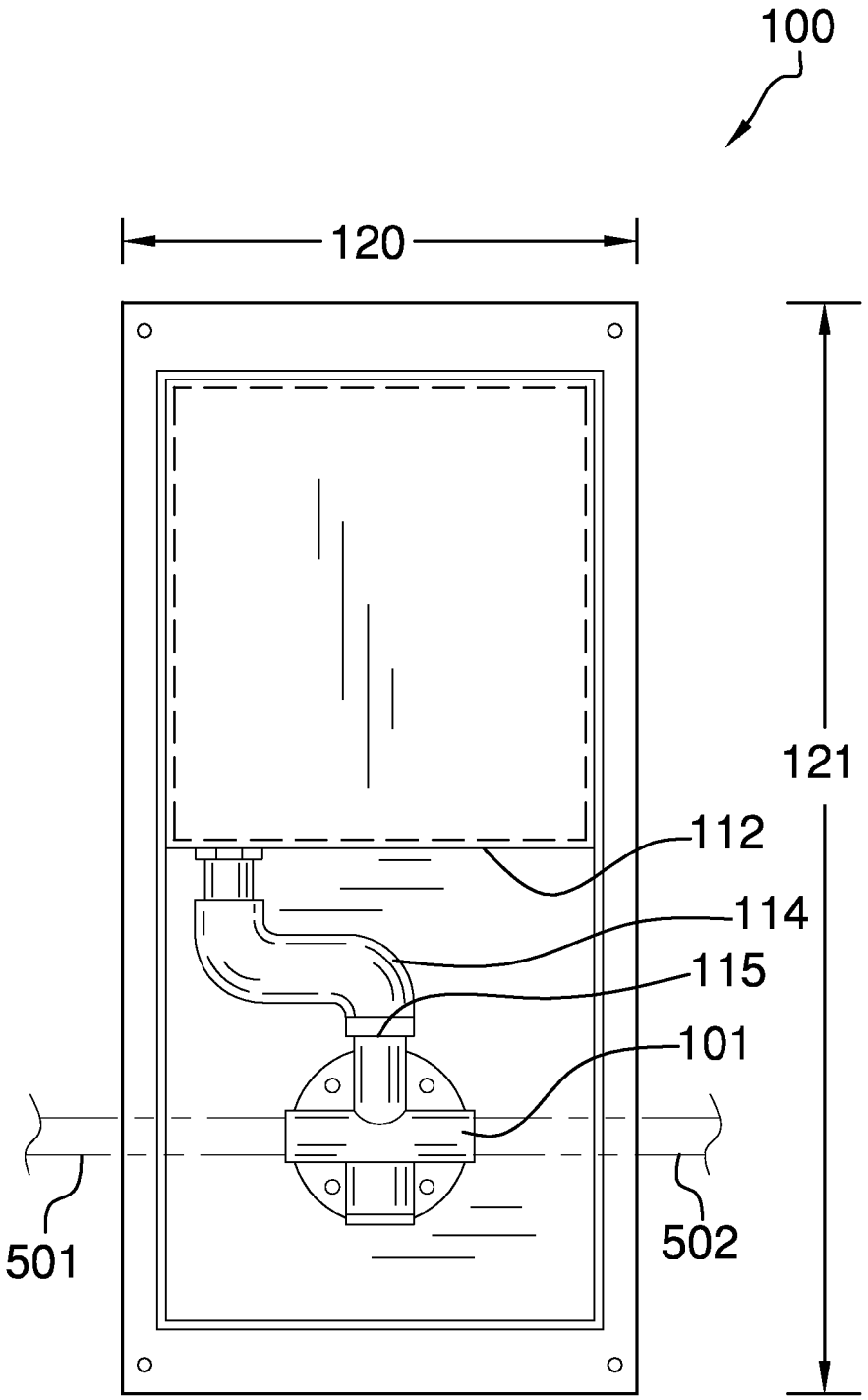
FIG. 3 is a rear view of an embodiment of the disclosure.
Figure 4:
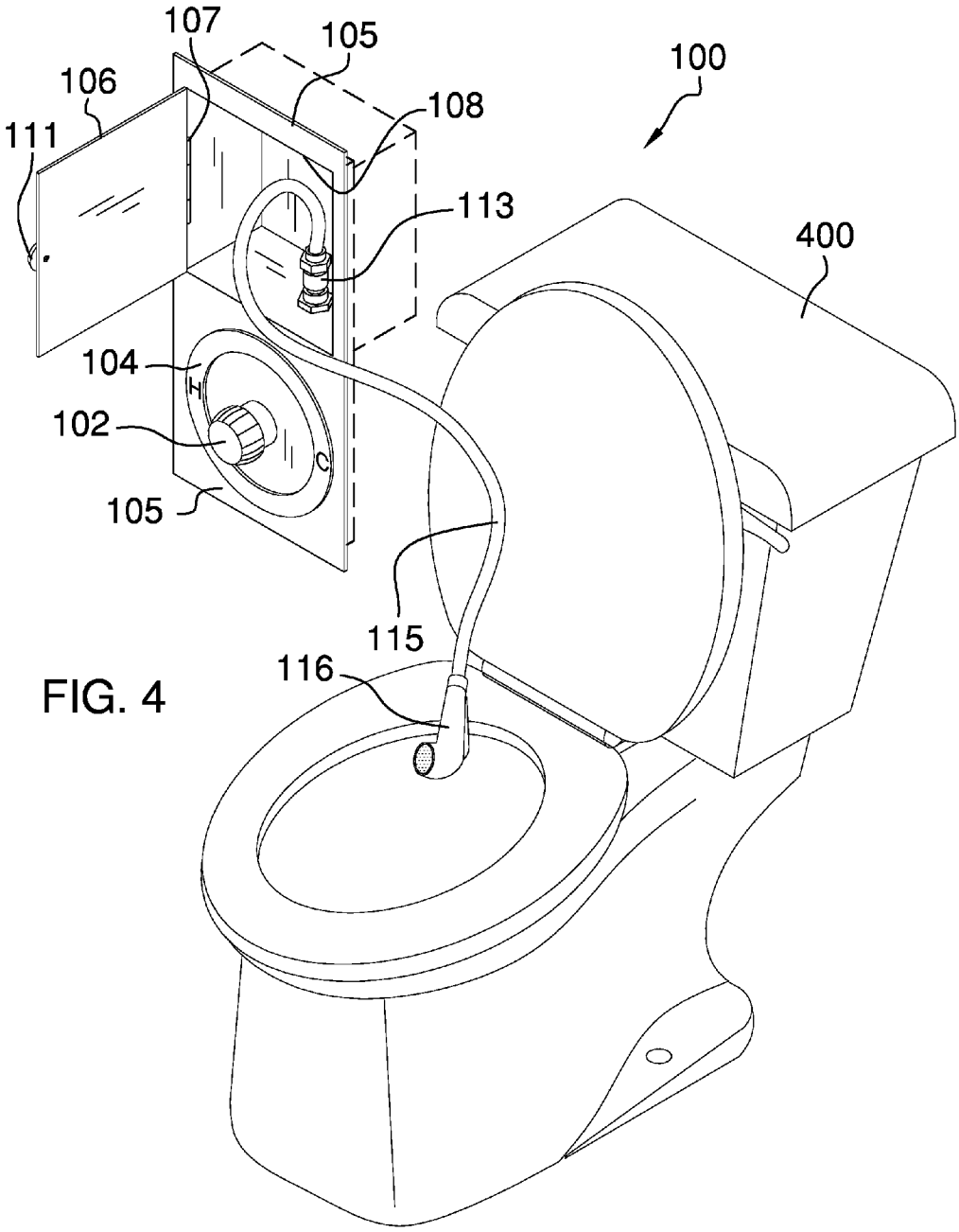
FIG. 4 is a first, perspective view of an embodiment of the disclosure in use.
Figure 5:
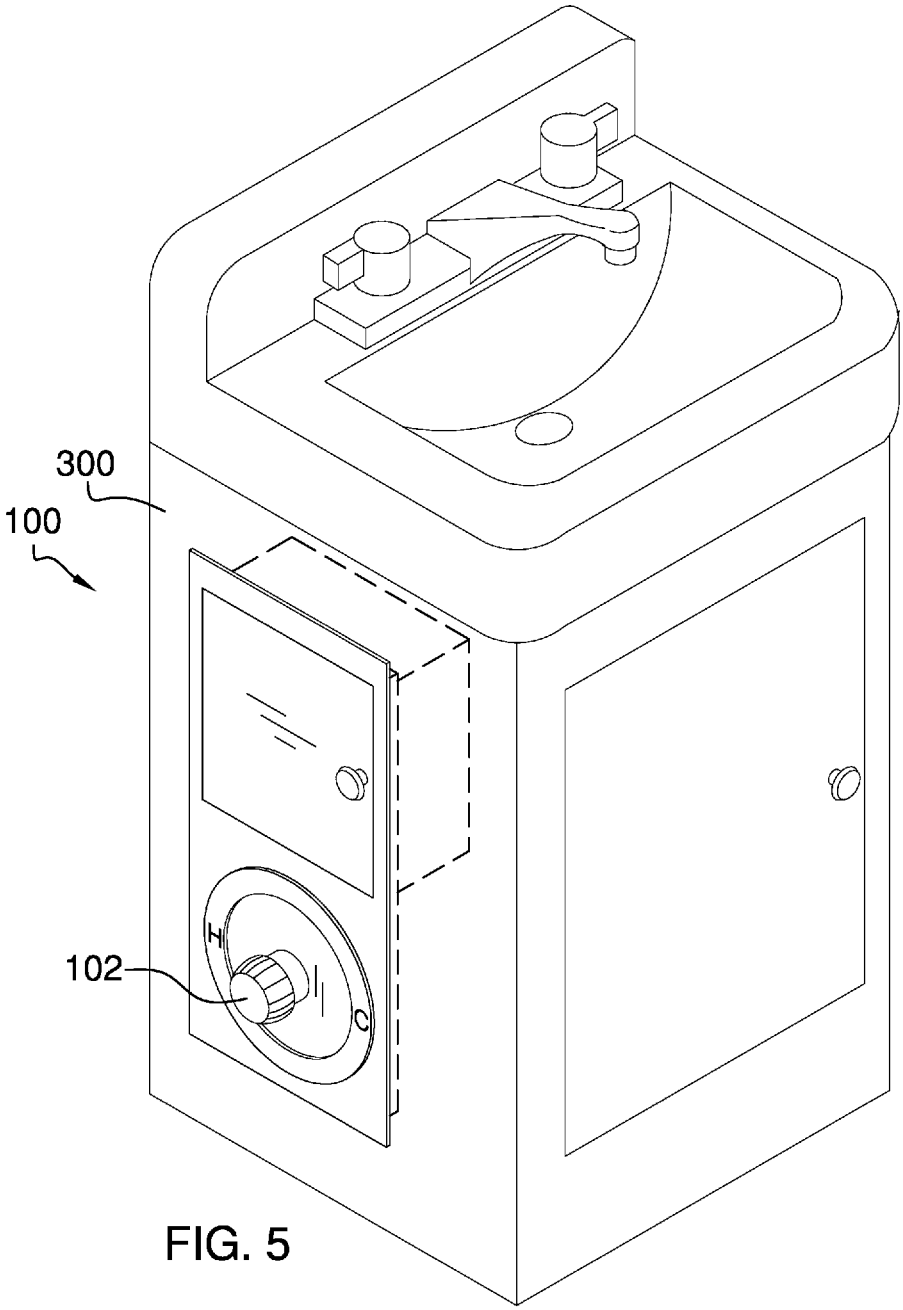
FIG. 5 is a second, perspective view of an embodiment of the disclosure in use.
Figure 6:
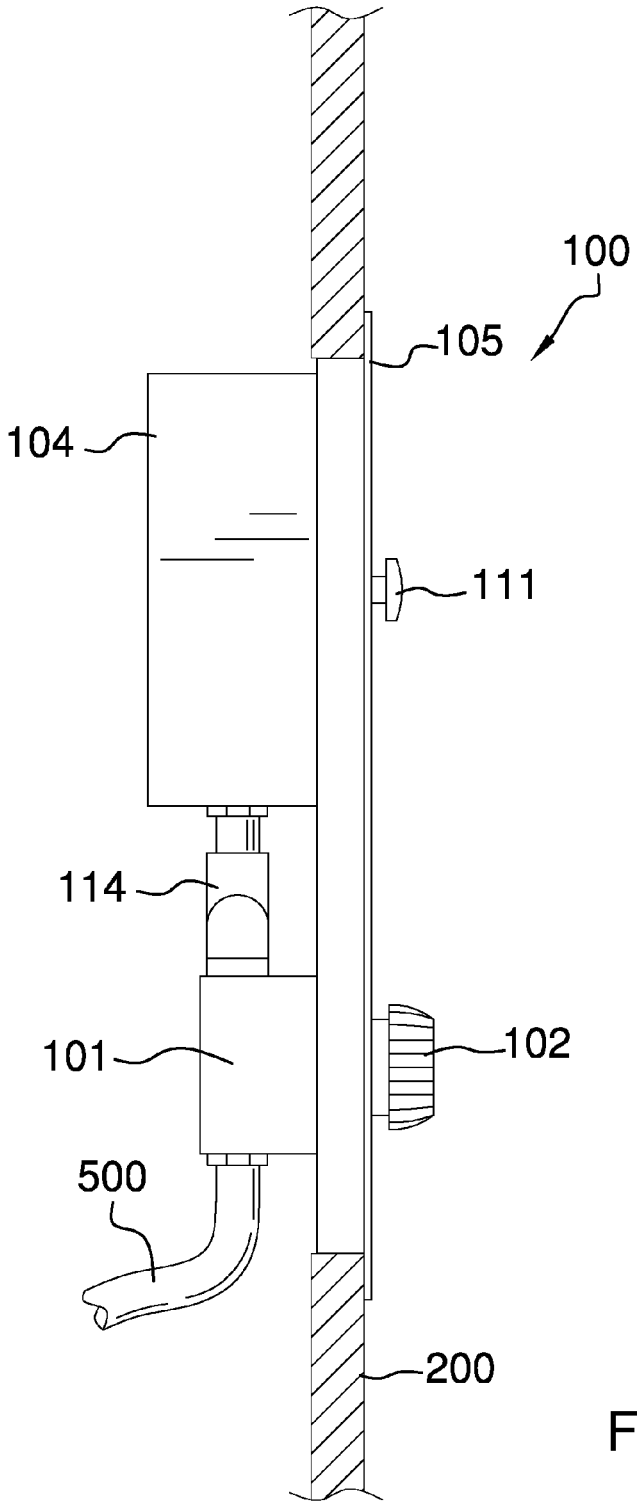
FIG. 6 is a detail view of an embodiment of the disclosure in use.

Detailed reference will now be made to a first potential embodiment of the disclosure, which is illustrated in FIGS. 1 through 6. The wall-mounted cabinet having a bidet extendable there from 100 (hereinafter invention) includes a valve 101 that is controlled via a control knob 102. The invention 100 includes a mounting frame 103 that supports both the valve and the control knob 102 underneath a water cabinet 104.

The mounting frame 103 includes a faceplate 105 that is set in a flush arrangement with a wall surface 200 or a cabinet 300. The mounting frame 103 extends rearwardly of the faceplate 105, and is used to support the faceplate 105 as well as the water cabinet 104. Moreover, the faceplate 105 is positioned in front of the water cabinet 104. The water cabinet 104 includes an access door 106 that opens to expose the water cabinet 104. The access door 106 is attached via a hinge 107 to the water cabinet 104. The faceplate 105 includes a door opening 108 to accommodate the access door 106.

The faceplate 105 includes a control knob face 109 that indicates how to control the temperature output of the valve 101 via the control knob 102. The faceplate 105 also includes at least one mounting hole 110 to secure the invention 100 against the wall surface 200 or the cabinet 300.

The water cabinet 104 is accessible from behind the access door 106. The access door 106 may include a doorknob 111 to aid in opening and closing of the access door 106. The water cabinet 104 is further defined with a first, bottom surface 112 that includes a water hose fixture 113 thereon. The water hose fixture 113 is affixed to the first, bottom surface 112 of the water cabinet 104. The water hose fixture 113 is connected to a first conduit 114 that extends downwardly from the water cabinet 104. Moreover, the first conduit 114 is located outside of and underneath the water cabinet 104. The first conduit 114 is also connected to the valve 101. The first conduit 114 connects to an outlet 115 of the valve 101.

The water hose fixture 113 is also connected to a water hose 115. The water hose 115 is a piece of flexible tubing of an undefined length, and which is connected to a sprayer nozzle 116. Both the water hose 115 and the sprayer nozzle 116 are able to be stored inside of the water cabinet 104 when the access door 106 is closed. Conversely, the water hose 115 and the sprayer nozzle 116 may be extended from the water cabinet 104 to provide a bidet function, and for adaptive use with a toilet 400. The sprayer nozzle 116 includes a trigger 117 that dispenses water from the sprayer nozzle 116.

The valve 101 is also adapted to be connected to a water line 500. The water line 500 being located inside of the cabinet 300 or behind the wall surface 200. It shall be noted that the water line 500 may be a single conduit, or a hot line 501 and a cold line 502 such that the control knob 102 is able to adjust the temperature of water dispensed via the valve 101.

The water cabinet 104 may be a box-shaped protruberance that extends rearwardly of the faceplate 105. The water cabinet 104 houses the water hose 115 and the sprayer nozzle 116 when not in use. The valve 101 is only accessible from behind the wall surface 200 or the cabinet 300. The invention 100 may include a quick connect fastener 118 that connects between the water hose 115 and the water hose fixture 113. The quick connect fastener 118 enables the water hose 115 to be disconnected from the water hose fixture 113 as needed.

The water cabinet 104, the faceplate 105, and the mounting frame 103 may be made of a material comprising a plastic, wood, metal, carbon fiber composite. The water hose 115 may be made of a plastic or rubber. The sprayer nozzle 116 may be made of a metal or a plastic. The overall size of the faceplate 105 may be further defined with a width 120 and a height 121. The width 120 being no less than 3 inches; whereas the height 121 is no less than 6 inches.

With respect to the above description, it is to be realized that the optimum dimensional relationship for the various components of the invention described above and in FIGS. 1 through 6, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A wall-mounted cabinet having a bidet extendable there from comprising:

a handheld bidet that is adapted to be mounted to a wall surface or a cabinet adjacent a toilet;

wherein a valve is controlled via a control knob;

wherein a mounting frame that supports both the valve and the control knob underneath a water cabinet;

wherein the mounting frame includes a faceplate that is adaptively set in a flush arrangement with the wall surface or the cabinet;

wherein the mounting frame extends rearwardly of the faceplate, and is used to support the faceplate as well as the water cabinet;

wherein the faceplate is positioned in front of the water cabinet;

wherein the water cabinet includes an access door that opens to expose the water cabinet;

wherein the access door is attached via a hinge to the water cabinet;

wherein the faceplate includes a door opening to accommodate the access door;

wherein the faceplate includes a control knob face that indicates how to control the temperature output of the valve via the control knob;

wherein the faceplate also includes at least one mounting hole to secure the faceplate against the wall surface or the cabinet;

wherein the water cabinet is accessible from behind the access door;

wherein the access door includes a doorknob to aid in opening and closing of the access door;

wherein the water cabinet is further defined with a first, bottom surface that includes a water hose fixture thereon;

wherein the water hose fixture is affixed to the first, bottom surface of the water cabinet; wherein the water hose fixture is connected to a first conduit that extends downwardly from the water cabinet; wherein the first conduit is located outside of and underneath the water cabinet;

wherein the first conduit is also connected to the valve; wherein the first conduit connects to an outlet of the valve;

wherein the water hose fixture is connected to a water hose; wherein the water hose is connected to a sprayer nozzle; wherein both the water hose and the sprayer nozzle are able to be stored inside of the water cabinet when the access door is closed; wherein the water hose and the sprayer nozzle are extended from the water cabinet to provide a bidet function, and for adaptive use with said toilet; wherein the sprayer nozzle includes a trigger that dispenses water from the sprayer nozzle.

2. The wall-mounted cabinet having a bidet extendable there from according to claim 1 wherein the valve is also adapted to be connected to a water line; wherein the water line being located inside of the cabinet or behind the wall surface; wherein the water line is a single conduit, or a hot line and a cold line such that the control knob is able to adjust the temperature of water dispensed via the valve.

3. The wall-mounted cabinet having a bidet extendable there from according to claim 2 wherein the water cabinet is a box-shaped protuberance that extends rearwardly of the faceplate; wherein the water cabinet houses the water hose and the sprayer nozzle when not in use; wherein the valve is only accessible from behind the wall surface or the cabinet.

4. The wall-mounted cabinet having a bidet extendable there from according to claim 3 wherein a quick connect fastener that connects between the water hose and the water hose fixture; wherein the quick connect fastener enables the water hose to be disconnected from the water hose fixture as needed.

* * * * *